US006891338B2

(12) United States Patent
Kubo

(10) Patent No.: US 6,891,338 B2
(45) Date of Patent: May 10, 2005

(54) PROJECTOR, LAMP LIGHTING CIRCUIT AND LAMP LIGHTING CONTROL METHOD

(75) Inventor: Yoshio Kubo, Ome (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 42 days.

(21) Appl. No.: 10/422,845

(22) Filed: Apr. 25, 2003

(65) Prior Publication Data

US 2003/0227765 A1 Dec. 11, 2003

(30) Foreign Application Priority Data

Jun. 6, 2002 (JP) ..... 2002-165685

(51) Int. Cl.[7] ..... G05F 1/00

(52) U.S. Cl. ..... 315/291; 315/307; 315/224; 315/312

(58) Field of Search ..... 315/291, 307, 315/224, 312, 316, 324, 314, 311, 65, 53

(56) References Cited

U.S. PATENT DOCUMENTS 6,184,632 B1 * 2/2001 Kamata et al. ..... 315/225

FOREIGN PATENT DOCUMENTS

| | | | |
|---|---|---|---|
| JP | 2000-131758 | A | 5/2000 |
| JP | 2000-131759 | A | 5/2000 |
| JP | 2001-133882 | | 5/2001 |
| JP | 2001-359025 | | 12/2001 |
| JP | 2002-341442 | A | 11/2002 |
| JP | 2003-31392 | A | 1/2003 |

OTHER PUBLICATIONS

Japanese Office Action dated Jul. 27, 2004 for Application , No. 2002–165685.

* cited by examiner

*Primary Examiner*—Tuyet Thi Vo
(74) *Attorney, Agent, or Firm*—Pillsbury Winthrop LLP

(57) ABSTRACT

A lamp lighting device is arranged such that the optimum specifications of discharge lamps that may be mounted are integrated or entered in advance into a control circuit and the type of a discharge lamp mounted is manually or automatically presented to a microcomputer. This allows any of the discharge lamps to be driven under the optimum conditions at all times. As a result, lamp makers and lamp power can be selected relatively freely, making it possible to select discharge lamps by purpose. Furthermore, the cost, color, outgoing luminous flux and noise caused by a cooling fan can be set to user's better likings.

18 Claims, 5 Drawing Sheets

PROJECTOR, LAMP LIGHTING CIRCUIT AND LAMP LIGHTING CONTROL METHOD

CROSS-REFERENCE TO RELATED APPLICATIONS

This application is based upon and claims the benefit of priority from the prior Japanese Patent Application No. 2002-165685, filed Jun. 6, 2002, the entire contents of which are incorporated herein by reference.

BACKGROUND OF THE INVENTION

1. Field of the Invention

The present invention relates to a projector which projects a video image onto a screen using a discharge lamp as a light source. More specifically, the present invention relates to a lamp lighting circuit which drives and controls the discharge lamp, and a method of controlling to light the lamp.

2. Description of the Related Art

A projector that uses a discharge lamp as the light source needs regular lamp replacement because the life of a lamp is incomparably shorter than other video displays. This is the most serious problem of the projector that uses a discharge lamp as the light source.

To solve this problem, lamp makers have invented all the possible device to prolong the life of discharge lamps. However, many constraints are imposed on the use of lamps because the luminous flux required is very great. That is, the performance required of a lamp can be displayed and the quality of the lamp as a product is ensured only when it is used under the constraints. The conditions under which the lamp is used include angles at which it is mounted, temperatures at which it is used, and driving power supply specifications.

The lighting of the lamp by regular power is also one of the basic constraints. The brightness adjustment based on power control as generally performed in illumination is basically impossible. Different regular power will require different optimum values of current and voltage at the start of the lamp and different timing of applying the current and voltage to the lamp. A lamp lighting circuit (this circuit is commonly known as "ballast") involves the optimum design of control process to correspond to regular power of a used lamp.

Under such situations, there are demands for suppressing noise caused by a cooling fan even if the outgoing luminous flux is reduced and for reducing the lamp power for energy saving. In recent years, to meet such demands, a discharge lamp and its associated lighting circuit have been provided which can change the power of a lamp in steps within a limited range to effect brightness control. However, these lamp and lighting circuit are implemented at the cost of shortening the life of a lamp and degrading its burst and flicker resistance. These are left as problems to be solved in future.

Japanese Unexamined Patent Publication 2001-133882 discloses a projection display which is composed of a main block and a control block. The main block is adapted to apply power to a discharge lamp and the control block is adapted to control the main block in accordance with the characteristic of the discharge lamp. When the discharge lamp is replaced with another lamp of a different type, the control block is replaced correspondingly. Thus, different discharge lamp control characteristics can be obtained. In this example, however, it is required to replace a control block each time a discharge lamp is replaced with another type of discharge lamp. This is impractical.

Used in part of conventional projectors, the discharge lamp and the lamp lighting circuit that allow power to be switched within a limited range are used under the circumstance that the performance is degraded within an acceptable range. Thus, in the prior art, when a discharge lamp is replaced or when the lamp driving power is changed, the lamp cannot be driven at the optimum level of performance.

A projector is required to produce outgoing luminous flux most suitable for an environment in which it is mounted. The outgoing luminous flux is virtually determined by the selection of a light source lamp, an optical system, and a light bulb. Among them, it is the light source lamp that most greatly influences the outgoing luminous flux.

As the light source lamp, use is generally made of a discharge lamp typified by an extra-high pressure mercury lamp. With this type of discharge lamp, in order to increase the outgoing luminous flux, the arc length is shortened to closely approximate a point light source, the shape of a reflecting mirror is optimized, or the shape of an emission tube is optimized. Recently, however, these elements each have been optimized by respective individual makers and consequently the outgoing luminous flux has become dependent mainly on the lamp power. Thus, knowing the specifications of the light bulb and the optical system allows a rough outgoing luminous flux of the projector to be determined from the wattage of the lamp.

If, when a projector is actually used, there arises the need of lamp replacement, a demand may be made for reducing noise caused by the cooling fan instead of dropping the lamp power because the luminous intensity is enough. In general, the greater the lamp power, the shorter the life of the lamp becomes. Hence, there is also a demand for dropping the lamp power in order to give the life preference over the luminous intensity. Depending on the maker, a replacement lamp is generally costly and its price varies according to its power. For this reason, there is also a demand for purchasing a replacement lamp less expensive than the one used so far even if the luminous intensity is changed. If a difference in hue of projected video images resulting from a difference in lamp power or maker is not desirable, there is also demand for changing the lamp power or maker. However, the conventional techniques cannot meet these problems satisfactorily.

BRIEF SUMMARY OF THE INVENTION

One embodiment of the present invention to provide a projector, a lamp lighting circuit and a method of control thereof which, irrespective of what type of light source lamp is mounted, allows the desired cost-performance to be displayed while keeping the quality of the lamp in the optimum condition.

According to a first aspect of the present invention, there is provided a projector which uses as a light source a selected one of a plurality of types of discharge lamps having different specifications, comprising: a lamp socket on which a selected discharge lamp is mounted; an entry unit through which type information of the discharge lamp mounted on the lamp socket is entered; a lamp lighting unit which is provided with a plurality of control sequences by lamp type to allow each discharge lamp to be lit according to specifications that conform to its type and lights the discharge lamp mounted on the lamp socket according to a control sequence that conforms to its type; and a control unit which instructs the lamp lighting unit to select a control sequence corresponding to the type information entered through the entry unit.

According to a second aspect of the present invention, there is provided a lamp lighting device which, at the time when a discharge lamp is mounted, is provided with type information representing specifications of the lamp, comprising: a storage unit which stores a plurality of control sequences by lamp type to allow the discharge lamp to be lit according to specifications that conform to its type; and a driving unit which reads a corresponding one of the control sequences from the storage unit in response to the type information of the discharge lamp and lights it according to the read control sequence.

According to a third aspect of the present invention, there is provided a control method for use with a projector adapted to selectively use as a light source a plurality of types of discharge lamps having different specifications, the method comprising the steps of: preparing a plurality of control sequences by lamp type to allow a discharge lamp to be lit according to specifications that conform to its type; entering type information of a discharge lamp when it is mounted; selecting a control sequence corresponding to the type information entered from the plurality of control sequences; and lighting the discharge lamp mounted according to the selected control sequence.

According to the present invention, even with the use of a discharge lamp having different specifications, starting and steady-state lamp currents and voltages can be selected so that the lamp is lit under optimum conditions.

Additional embodiments and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

A preferred embodiment of the present invention will be described in detail hereinafter with reference to the accompanying drawings.

Figure 1:
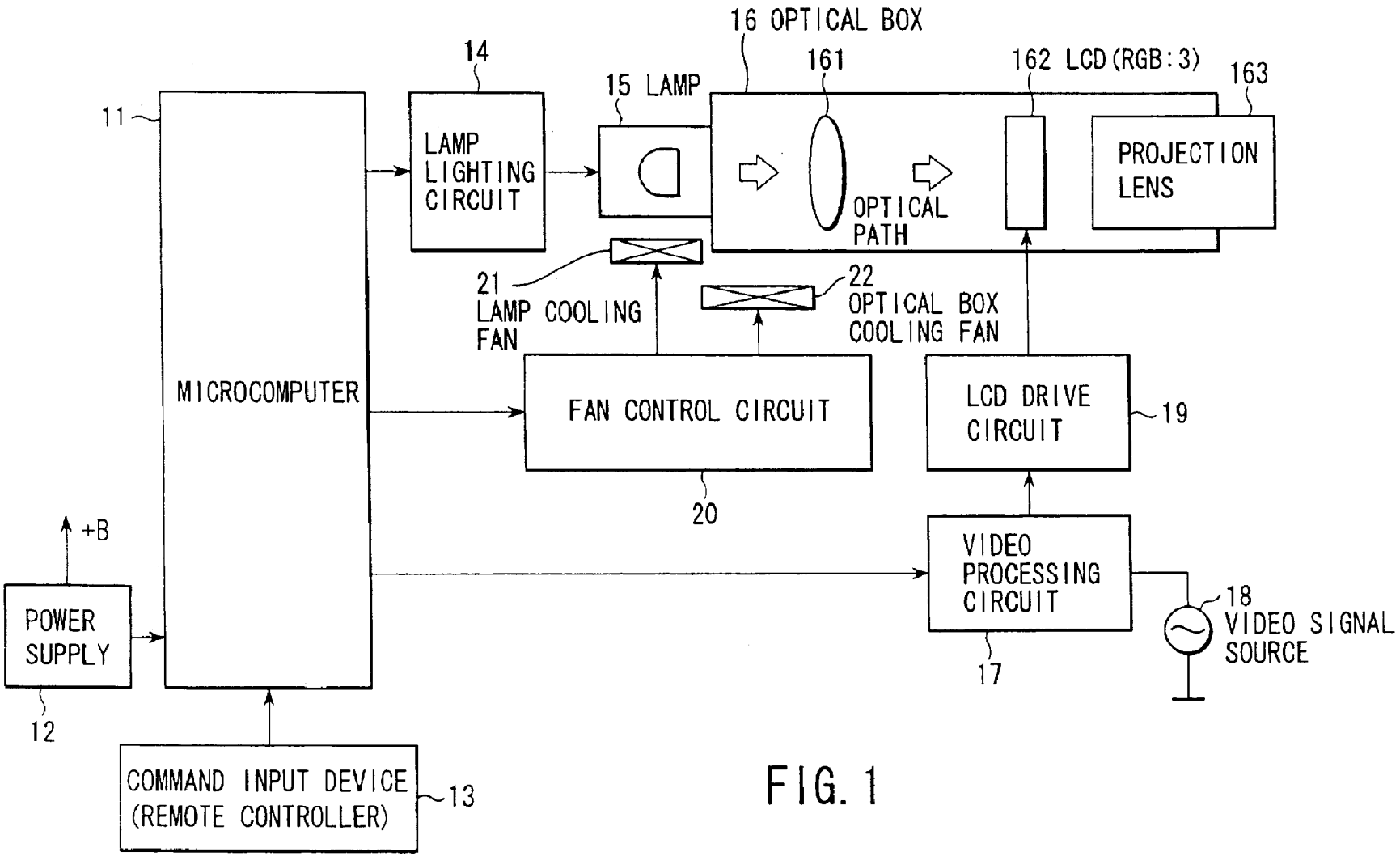
FIG. 1 is a system block diagram of a projector of the preferred embodiment of the present invention.

FIG. 1 is a system block diagram of a projector according to the preferred embodiment of the present invention. When a power supply 12 is switched on, a microcomputer 11 is activated to control functional blocks in response to commands from a command input device 13 including a remote controller.

A lamp lighting circuit 14 is activated as instructed by the microcomputer 11 to drive and turn on a discharge lamp 15 according to its optimum specifications. Light rays from the discharge lamp 15 are directed into an optical box 16, then separated and focused by an internal optical system 151 onto three LCDs (liquid crystal displays) 162 corresponding to R (red), G (green) and B (blue). The light rays passed through the LCDs 162 are projected by a projection lens 163 onto a screen (not shown).

A video processing circuit 17 is responsive to a mode set command and a drive command from the microcomputer 11 to separate a video signal from a video signal source 18 into R, G and B components. The resulting R, G and B component outputs are sent through an LCD drive circuit 19 to the LCDs 162 in the optical box 16, whereby a video image is displayed.

A fan control circuit 20 is responsive to a mode set command and a drive command from the microcomputer 11 to drive and control a lamp cooling fan 21 and an optical box cooling fan 22 according to specifications by mode.

Figure 2:
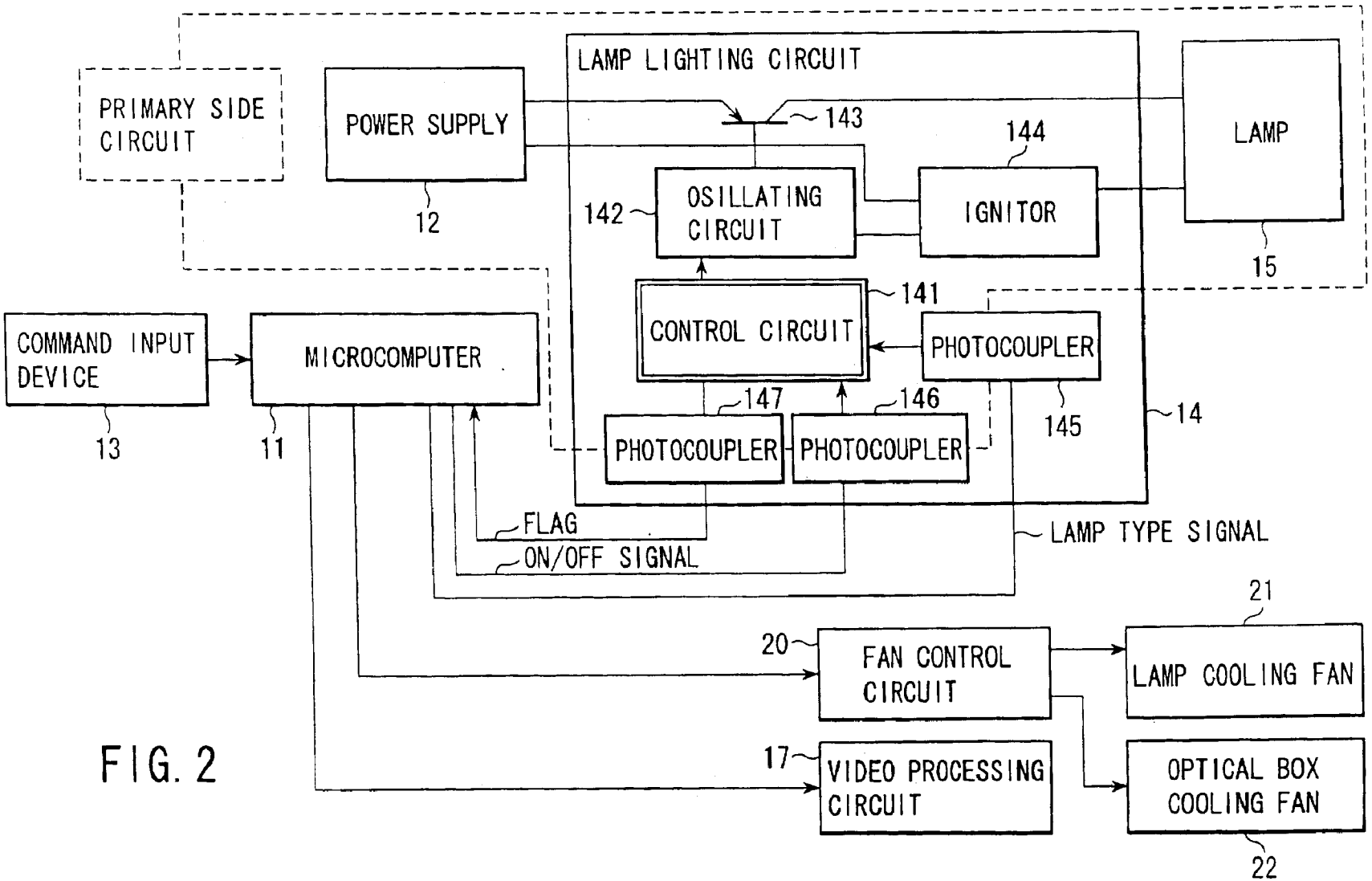
FIG. 2 shows the specific arrangement of the lamp lighting circuit and its input-output relationship to the microcomputer.

FIG. 2 shows the specific arrangement of the lamp lighting circuit 14 and its input-output relationship to the microcomputer 11. In FIG. 2, as the discharge lamp 15 use is made of a standard extra-high pressure mercury lamp or metal halide lamp. The power consumption of the lamp used is selected according to the specifications of the projector. At present, the principal power consumption is set in the range of 100 to 300 W.

The lamp lighting circuit 14 is designed to turn on or off the discharge lamp 15 under optimum conditions. A control circuit 141 in the lamp lighting circuit 14 controls the oscillating frequency of an oscillating circuit 142 to suit the optimum power of the lamp. A switching element 143 periodically interrupts current supplied from the power supply 12 to the discharge lamp 15 in accordance with the oscillating signal from the oscillating circuit 142, thereby controlling the power applied to the discharge lamp. The power to the discharge lamp depends on the period at which the current is interrupted. An ignitor 144 generates a high-voltage current and applies it to the discharge lamp 15 to start the lighting thereof.

The control circuit 141 is coupled with the microcomputer 11 by photocouplers 145, 146 and 147 for electrically isolating the primary side circuit from the signal processing side circuit. The photocouplers 145, 146 and 147 are connected to the microcomputer 11 by a lamp type signal line, a lamp on/off signal line, and a flag signal line, respectively. At lamp replacement time, the microcomputer 11 responds to a lamp type command manually input to the command input device 13 to produce and send a lamp type signal to the control circuit 141. Also, the microcomputer responds to power supply on/off or a lighting/extinct command from the command input device 13 to produce and send a lamp on/off signal to the control circuit 142. The control circuit 141 detects the on/off of the lamp based on the lamp current and sends the result to the microcomputer 11 in the form of a flag.

Figure 3:
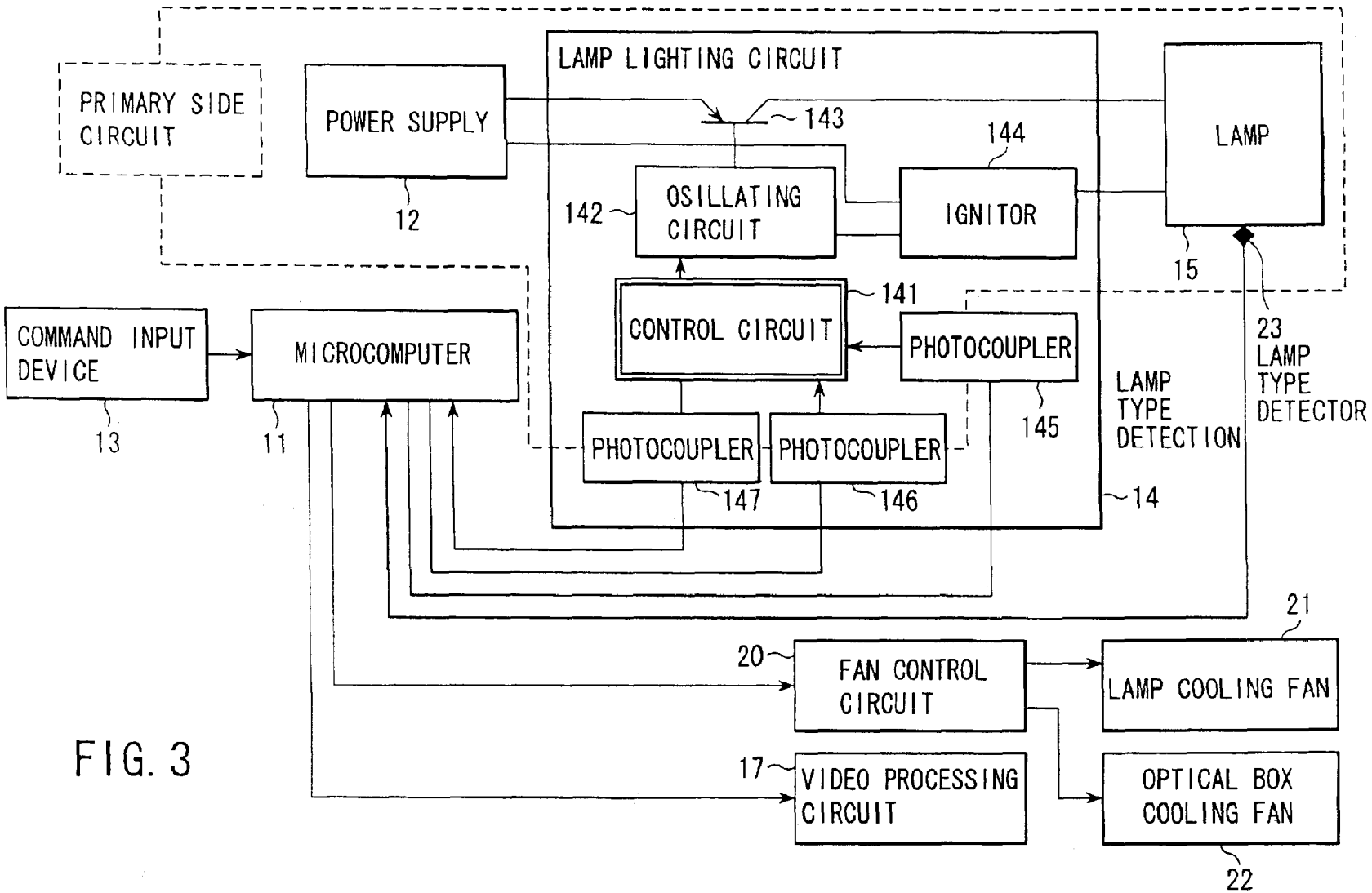
FIG. 3 shows the automatic lamp type detection and control configuration in accordance with the preferred embodiment.

The arrangement of FIG. 2 makes an assumption that the user tells the microcomputer the type of a lamp through the command input device 13 (i.e., manual entry of lamp type data). The arrangement can be modified so as to, as shown in FIG. 3, fit a lamp type detector 23 to the unit in which the discharge lamp 15 is mounted so that it will detect the type of a replacement lamp at the time of replacement of the discharge lamp 15 and automatically tell the microcomputer 11 the detected lamp type. By so doing, the user can be freed from the manual entry.

Figure 4:
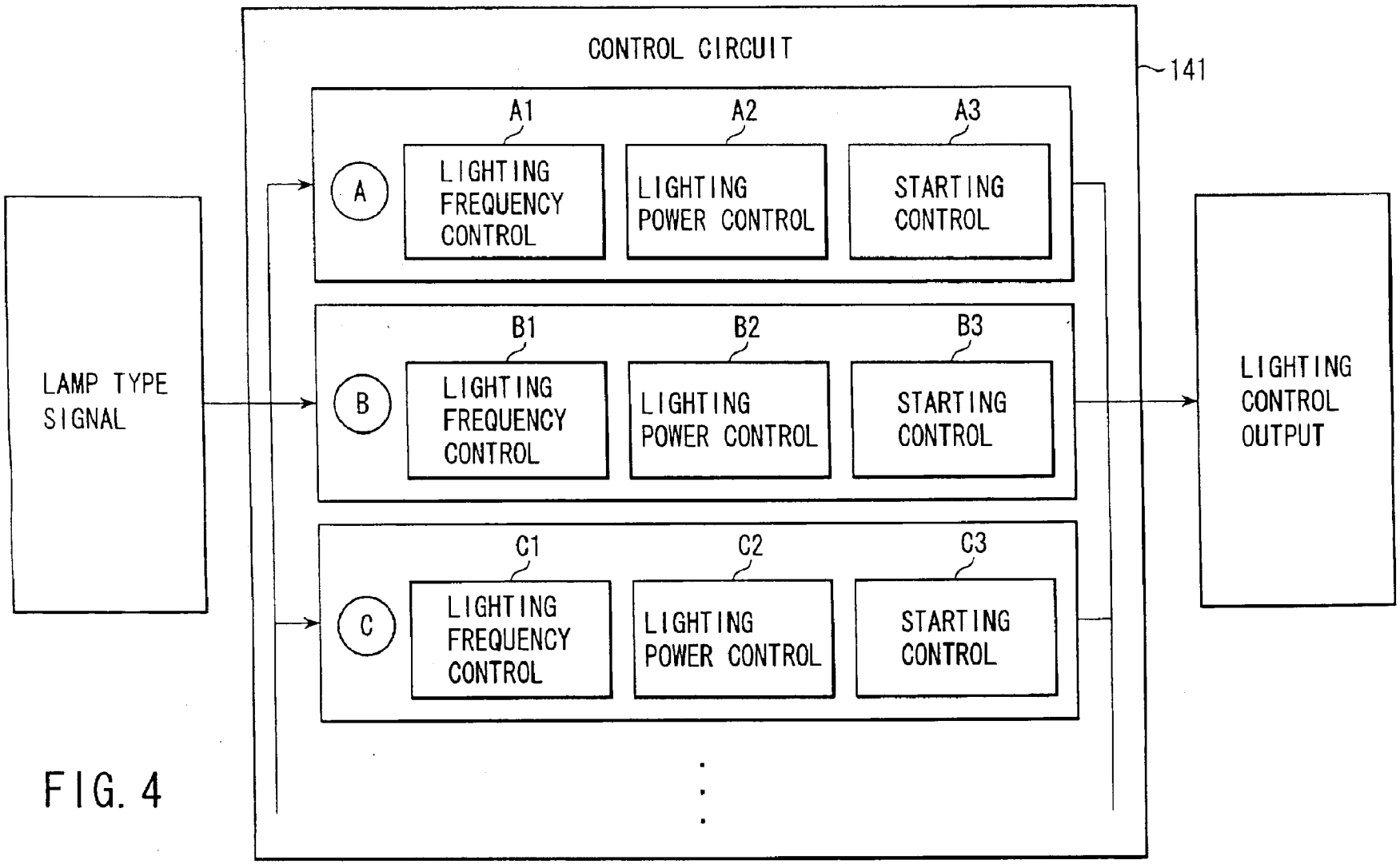
FIG. 4 is the more detailed block diagram of the control circuit in accordance with the preferred embodiment.

FIG. 4 shows the arrangement of the control circuit. The control circuit 141 have control sequences A, B, C, etc. previously built in to correspond to a number of lamp types and, upon receiving a lamp type signal from the microcomputer 11, selectively activates a corresponding one of these control sequences to control the oscillating circuit 142 according to its control contents. The control sequences A, B, C, . . . include lighting frequency control processes A, B1, C1, . . . , lighting power control processes A2, B2, C2, . . . , and starting control processes A3, B3, C3, . . . . The optimum values by lamp type, such as the rush current value and its duration at the start of lighting, the power values based on current and voltage up to the steady lighting, have been entered in advance. This allows each type of lamp to be lit under optimum conditions. These processes are implemented in hardware, but may be implemented in software.

The optimum conditions are those in which the discharge lamp is allowed to have the longest possible life, the discharge lamp 15 suffers no flicker and rupture throughout lighting, the starting performance of the discharge lamp 15 is not degraded, and the outgoing luminous flux rises at a convenient speed. The lamp type is a category in the case where there is need to switch the control sequences in the lamp lighting circuit 14 according to the manufacturer, power, interelectrode voltage, etc., for the purpose of using the discharge lamp 15 under the optimum conditions.

Knowing the type of the discharge lamp 15, the microcomputer 11 properly sets up and controls the video processing circuit 17 and the fan control circuit 20, thereby allowing the color adjustment and the cooling state to be reproduced to suit the incorporated discharge lamp 15.

Figure 5:
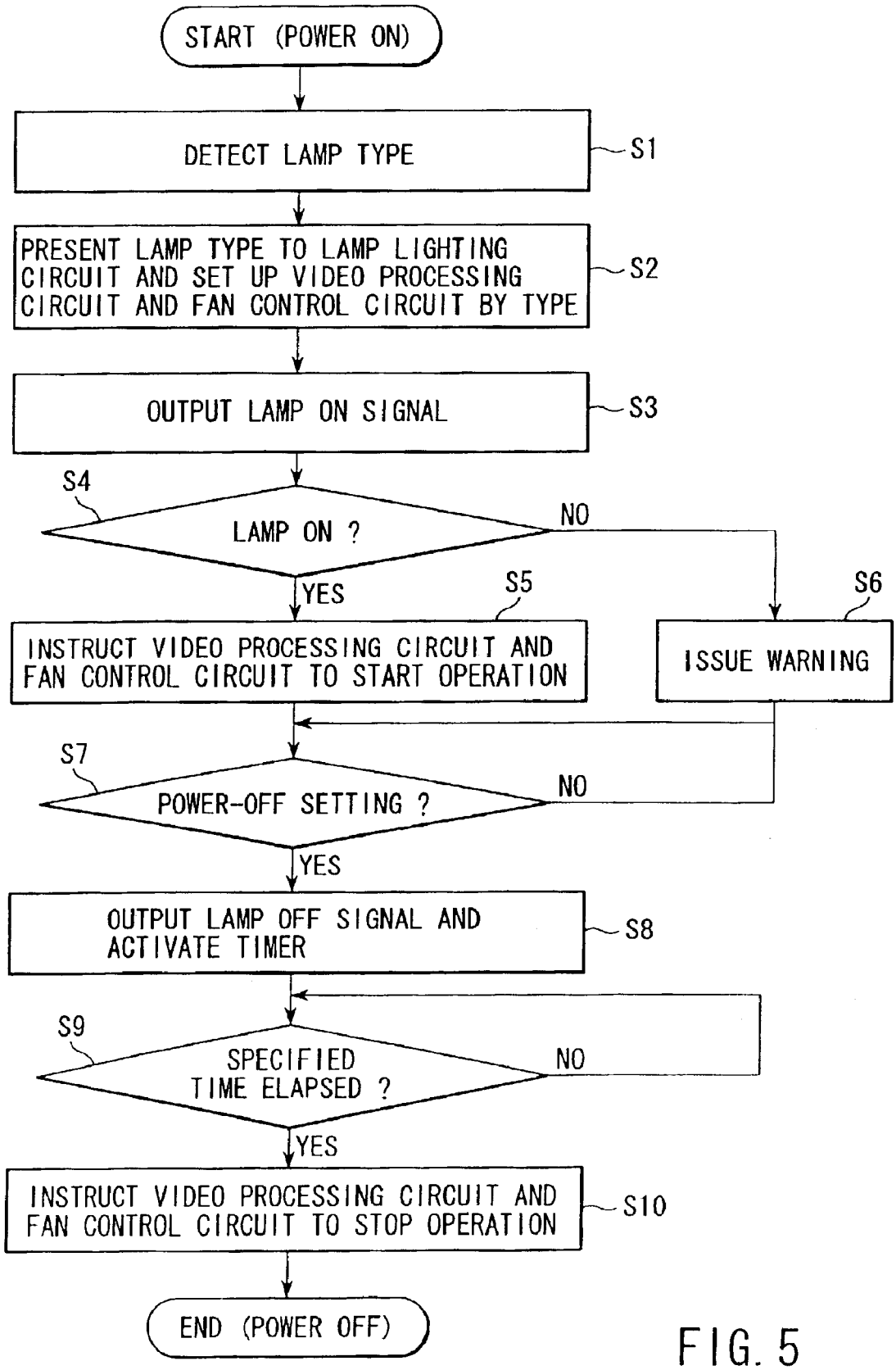
FIG. 5 is a flowchart for control processing of the microcomputer in accordance with the preferred embodiment.

Reference is now made to FIG. 5 to describe the processing operation of the projector thus configured.

FIG. 5 is a flowchart for the control processing by the microcomputer 11. First, the power supply 12 is turned on to cause the system to go into the activated state. The user is prompted to enter lamp type data (if there is no change, the previous data is used as it is) or the lamp type from the lamp type detector 23 is automatically identified (step S1). The microcomputer presents the type of the discharged lamp 15 currently mounted to the control circuit 141 in the lamp lighting circuit 14. The control circuit then switches the control sequences and causes the video processing circuit 17 and the fan control circuit 20 to go into the mode corresponding to the lamp type (step S2).

Next, the microcomputer 11 sends a lamp on signal to the control circuit 141 to start the lighting of the lamp (step S3). At this point, a flag from the control circuit 141 is checked to confirm whether or not the lamp 15 has lit up normally (step S4). If it does, the microcomputer instructs the video processing circuit 17 and the fan control circuit 20 to start the processing and control operations (step S5). If it does not, the microcomputer issues a warning (step S6). After step S5 or S6, the system is placed in the wait state until power-off setting (step S7).

In the presence of power-off setting, the microcomputer sends a lamp off signal to the control circuit 141 to turn off the lamp and at the same time activates a timer (not shown) to wait until a specified time elapses (steps S8 and S9). After the specified time has elapsed, the microcomputer instructs the video processing circuit 17 and the fan control circuit 20 to stop their operation (step S10) and turns off the power supply, thereby terminating a sequence of processes.

That is, with the conventional lamp lighting circuit based on fixed power, trying to use a lamp lighting circuit designed for use with a 150-W lamp manufactured by A company for a 150-W lamp made by B company results in failure of the B company lamp to light up under the optimum conditions. This is because the lamps of both the A company and the B company are differently designed in interelectrode distance, internal fillings, the shape of emission tube, etc. Even with a lamp of the A company, it will also not be lit under the optimum conditions if it is designed differently in power, interelectrode distance, internal fillings, the shape of emission tube, etc.

In contrast, the lamp lighting circuit of the invention is arranged such that the optimum specifications of discharge lamps that may be mounted are integrated or entered in advance into the lamp lighting circuit 14 and the type of a discharge lamp mounted is manually or automatically presented to the microcomputer 11. This allows any of the discharge lamps to be driven under the optimum conditions at all times. As a result, lamp makers and lamp power can be selected relatively freely. This makes it possible to set the cost, color, outgoing luminous flux, noise caused by the cooling fan to user's likings. That is, even if a 150-W lamp manufactured by A company has been mounted on a projector in the as-shipped condition, at lamp replacement time the user is allowed to select from various options, such as a B company's lamp that is less costly, a C company's lamp that is brighter, a D company's lamp that emits light of different color, etc.

In addition, by devising a structure of the lamp socket in such a way as to fit the lamp type detector 23 to the lamp socket as shown in FIG. 3, merely mounting a lamp on the lamp socket allows its type to be detected automatically and allows various settings, such as a video mode (e.g., brightness and hue), a fan voltage, etc., to be controlled automatically. For example, a projection is provided in a given position on a lamp itself or the lamp socket and a switch that forms the pair to that projection is provided on the projector body. By setting up several positions for each of the projection and the switch, information, such as A company's 150-W lamp, B company's 120-W lamp, etc., can be delivered on lamp type information to the control circuit 141 in the lamp lighting circuit 14 through the microcomputer 11, allowing switching to the optimum conditions.

As another approach to automatically identify the lamp type upon lamp mounted, it will be suggested to fit a radio transmitter tag, magnetic recording tag, or light emitter tag, which are adapted to emit type identification information, to a lamp and integrate a radio receiver, magnetic pickup, or optical detector into the lamp socket.

As described above, this embodiment allows the user to make a selection from lamps relatively freely to his or her liking. In addition, a projector designer is relieved of the burden of designing a new lamp lighting circuit when he or she wants to incorporate a lamp of a different maker or different power into the same housing or at the time of development of a new product. As a result, it becomes possible to reduce the development cost of individual projectors.

The present invention is not limited to the embodiment described above. It is also possible to add and alter other control items than those illustrated, allowing control accuracy to be further increased.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A projector which uses as a light source a selected one of a plurality of types of discharge lamps having different specifications, comprising:

a lamp socket on which a selected discharge lamp is mounted;

an identification unit by which type information of the discharge lamp mounted on the lamp socket is identified;

a lamp lighting unit which is provided with a plurality of control sequences by lamp type to allow each discharge lamp to be lit according to specifications that conform to its type and lights the discharge lamp mounted on the lamp socket according to a control sequence that conforms to its type; and a control unit which instructs the lamp lighting unit to select a control sequence corresponding to the type information identified by the identification unit.

2. The projector according to claim 1, wherein each of the control sequences includes at least one of the lighting frequency or power at steady lighting time, the rash current value and its duration at the start of lighting, the power application time up to the steady lighting, and the controlled value of the frequency.

3. The projector according to claim 1, wherein the identification unit is provided in the lamp socket and automatically identifies type information marked on a discharge lamp when it is mounted.

4. The projector according to claim 1, further comprising:

a fan driving unit which drives a fan to cool a heated unit including the discharge lamp; and wherein the control unit controls the driving state of the fan driving unit on the basis of the lamp information.

5. The projector according to claim 1, further comprising:

a video signal processing unit which adjusts a video signal to be projected; and a display unit which displays a video signal output from the video signal processing unit on a penetrative screen as a video image and projects the video image on the penetrative screen by using light rays from the discharge lamp; and wherein the control unit controls the quantities of adjustment of the video signal in the video signal processing unit on the basis of the type information.

6. The projector according to claim 5, wherein the control unit controls at least the quantities of adjustment of the colors of the video image displayed on the transparent screen according to the lamp information.

7. A control method for use with a projector adapted to selectively use as a light source a plurality of types of discharge lamps having different specifications, the method comprising the steps of:

preparing a plurality of control sequences by lamp type to allow a discharge lamp to be lit according to specifications that conform to its type;

identifying type information of a discharge lamp when it is mounted;

selecting a control sequence corresponding to the type information entered from the plurality of control sequences; and lighting the discharge lamp mounted according to the selected control sequence.

8. The method according to claim 7, wherein each of the control sequences includes at least one of the lighting frequency or power at steady lighting time, the rash current value and its duration at the start of lighting, the power application time up to the steady lighting, and the controlled value of the frequency.

9. The method according to claim 7, wherein in the step of identifying type information automatically identifies type information marked on the discharge lamp when it is mounted.

10. The method according to claim 7, further comprising the step of:

controlling the driven state of a fan to cool a heated unit including the discharge lamp on the basis of the type information.

11. The method according to claim 7, further comprising the steps of:

displaying a video image on a display screen of a penetrative display device;

projecting the video image on the display screen by using light rays from the discharge lamp; and adjusting a video signal applied to the penetrative display device on the basis of the type information.

12. The method according to claim 11, wherein, in the step of adjusting a video signal, the video signal is adjusted to adjust at least the color of the video image displayed on the display screen.

13. A projector which uses as a light source a selected one of a plurality of types of discharge lamps having different specifications, comprising:

a lamp socket on which a selected discharge lamp is mounted;

identification means for identifying type information of the discharge lamp mounted on the lamp socket;

lamp lighting means, provided with a plurality of control sequences by lamp type to allow each discharge lamp to be lit according to specifications that conform to its type, for lighting a discharge lamp mounted on the lamp socket according to a control sequence that conforms to its type; and control means for instructing the lamp lighting means to turn on or off the discharge lamp mounted and select a control sequence corresponding to the type information identified through the identification means.

14. The projector according to claim 13, wherein each of the control sequences includes at least one of the lighting frequency or power at steady lighting time, the rash current value and its duration at the start of lighting, the power application time up to the steady lighting, and the controlled value of the frequency.

15. The projector according to claim 13, wherein the identification means is provided in the lamp socket and automatically identifies type information marked on a discharge lamp when it is mounted.

16. The projector according to claim 13, further comprising:

fan driving means for driving a fan to cool a heated unit including the discharge lamp; and wherein the control means controls the driving state of the fan driving unit on the basis of the lamp information.

17. The projector according to claim 13, further comprising:

video signal processing means for adjusting a video signal to be projected; and display means for displaying a video signal output from the video signal processing means on a transmissive screen as a video image and projecting the video image on the transmissive screen by using light rays from the discharge lamp; and wherein the control means controls the quantities of adjustment of the video signal in the video signal processing unit on the basis of the lamp information.

18. The projector according to claim 17, wherein the control means controls at least the quantities of adjustment of the colors of the video image displayed on the transparent screen according to the lamp information.

* * * * *